United States Patent [19]

Gamberini

[11] Patent Number: 4,874,280

[45] Date of Patent: Oct. 17, 1989

[54] SELF-SERVICE, COMPUTER-OPERATED, MECHANICAL-ELECTRONIC EQUIPMENT FOR PARKING VEHICLES CLOSELY IN SIDE BY SIDE ROWS

[75] Inventor: Enzo Gamberini, Zola Predosa, Italy

[73] Assignee: V.B. Di Gamberini Enzo, Bologna, Italy

[21] Appl. No.: 887,812

[22] Filed: Jul. 21, 1986

[51] Int. Cl.[4] ..... E04H 6/34

[52] U.S. Cl. ..... 414/234; 104/172.2; 104/172.3; 414/237; 414/242

[58] Field of Search ..... 198/793; 414/234, 236, 414/237, 238, 242, 252, 231; 104/139, 140, 165, 172.1, 172.2, 172.3

[56] References Cited

U.S. PATENT DOCUMENTS

| | | | |
|---|---|---|---|
| 1,605,220 | 11/1926 | Cuvillier et al. | 414/234 |
| 1,683,492 | 9/1928 | Ruth | 414/234 X |
| 1,800,495 | 4/1931 | Bell . | |
| 1,863,748 | 6/1932 | Geiger | 414/242 |
| 2,849,127 | 8/1958 | Densmore | 414/242 |
| 3,032,212 | 5/1962 | Gaskin et al. | 414/237 X |
| 3,390,791 | 7/1968 | Baldwin et al. | 414/237 X |
| 3,432,044 | 3/1969 | Stienen | 414/237 |
| 3,517,836 | 6/1970 | Bosco | 414/234 |
| 3,882,793 | 5/1975 | Wakabayashi | 104/172.3 X |
| 3,984,012 | 10/1976 | Ennis et al. . | |
| 4,718,349 | 1/1988 | Wahren | 104/165 |

OTHER PUBLICATIONS

Eaton Automated Systems, Modern Materials Handling, pg. 4, Feb. 1980.

*Primary Examiner*—James R. Brittain

*Attorney, Agent, or Firm*—Stevens, Davis, Miller & Mosher

[57] ABSTRACT

The equipment comprises: a track, fixed to a base, extending endlessly so as to define two longitudinal runways; a plurality of movable elements of support, equidistant one with respect to the other, sliding on the track; a plurality of platforms on which to receive an identical plurality of vehicles, each platform resting fixedly on one of the movable elements of support; a power unit for driving synchronously, in opposite directions, the movable elements, with it being possible for each platform to transit at a station for loading and unloading vehicles onto and from the platform; a movable bar for barring access to the station; and a programmed unit, set in action through a card, for operating the power unit and the bar, as well as destined to operated a corresponding signal unit in consequence of the existence of at least one free platform.

3 Claims, 4 Drawing Sheets

FIG.2
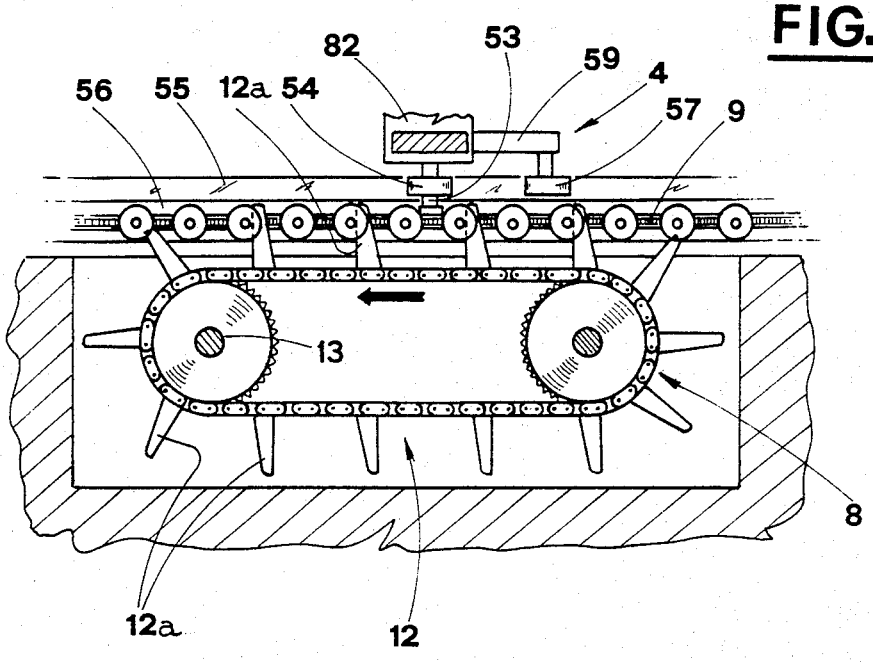
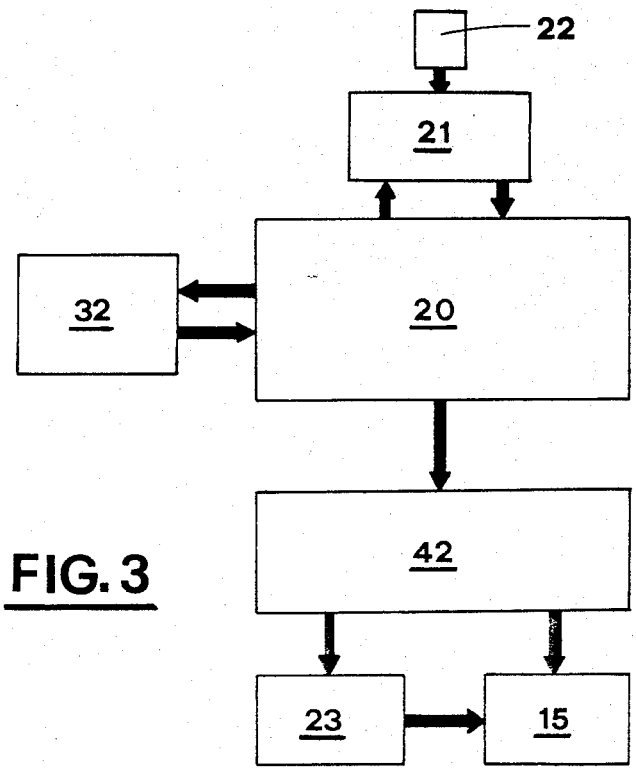
FIG. 3

FIG.6
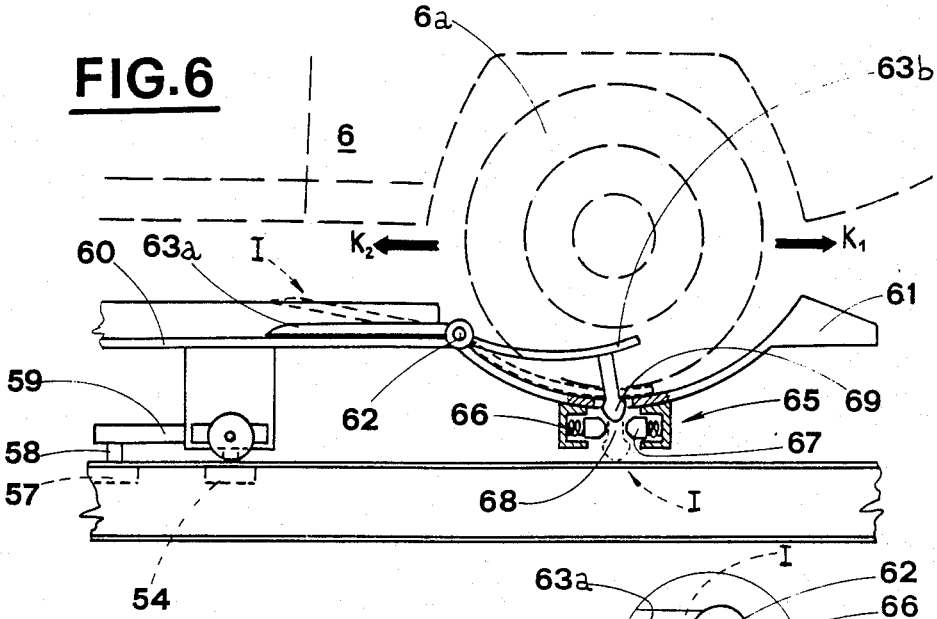
FIG.7
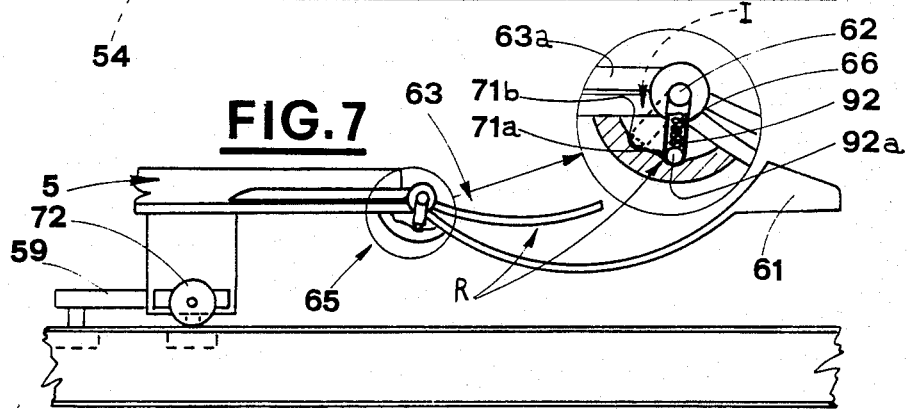
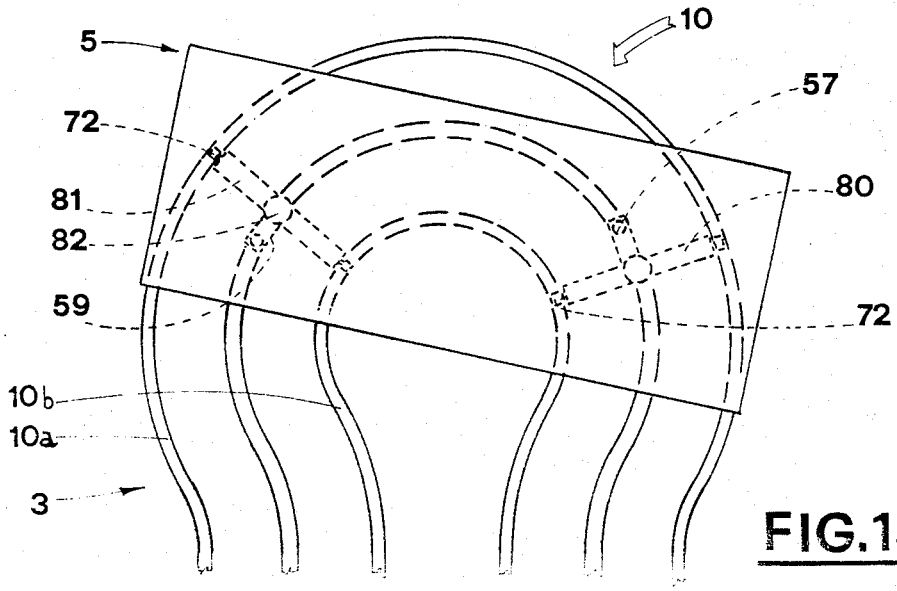
FIG.1a

SELF-SERVICE, COMPUTER-OPERATED, MECHANICAL-ELECTRONIC EQUIPMENT FOR PARKING VEHICLES CLOSELY IN SIDE BY SIDE ROWS

BACKGROUND OF THE INVENTION

The invention relates to a self service, computer operated, mechanical-electronic equipment for parking, vehicles closely in side by side rows.

DESCRIPTION OF THE PRIOR ART

Everybody knows just how much trouble vehicles jamed in a town centre cause to people at large and to the environment. This blocking of streets is the result of inadequate public and private parking facilities. The said parking facilities are either out in the open (occupying suitable urban land) or else indoor garages built, or adapted, to house vehicles.

In the first case, the urban area is subdivided into parking lots (for example, rectangular boxes side by side, staggered, or arranged like the teeth of a comb, etcetera), with lanes provided in order to gain access to and exit from the car park.

With this particular method, the best possible use is not made of the urban area, and absolutely nothing is done to protect the vehicles against inclement weather or articles left inside the vehicles being stolen (with the breakage of windows and/or the forcing of doors, or against even the theft of any one of the vehicles. Obviously in a guarded car park the problem of pilfering can be assumed to be prevented, though this adversely affects the average cost of the car parking facilities.

With open air car parks of a considerable size (such as those made in the vicinity of airports), added to the aforementioned problems are others; for instance, the amount of time wasted in an endeavour to find a free parking space, to find the way back to this, and to pay for the guarded service, the cost of which may be the subject of disagreement etcetera.

The operation of garages provided inside buildings necessitates personnel being used, and this, as is known, has a considerable effect on the cost of the service.

Except for protection being provided against thefts and inclement weather, the same problems exist with this modus operandi as with method number one, namely high parking costs.

In certain cases the vehicles are crowded unbelievably into the garages, with each vehicle practically surrounded by other vehicles.

This compels drivers to leave the keys of the vehicles with the custodian and, in turn, this person to move the vehicles continuosly in compliance with the programmed or contingent requirements of the various owners.

Lastly, everyone is aware that the coachwork of vehicles destined to stand in parking areas (both in and outdoors) deteriorates progressively due to dents, bangs and scratches etcetera.

SUMMARY OF THE INVENTION

The object of the invention is to propose computer operated mechanical-electronic equipment of the self service type that permits the best possible use to be made of the parking area, gives protection to the vehicles placed therein, and with which the sum to be paid for the parking service is defined in a clearcut manner.

This object is achieved with the equipment according to the invention that is characterized by the fact of comprising: at least one guide, fixed to a base, extending endlessly so as to define at least two longitudinal runways; movable elements of support, equidistant one with respect to the other, carried by the said base in a way whereby able to undergo sliding motion controlled by the said guide; a plurality of platforms on which to receive an identical plurality of vehicles, each platform resting fixedly on one of the said movable elements of support; means for driving synchronously and in both directions, the said movable elements of support, with it being possible for each platform to transit in the region of a station for loading and unloading at least one vehicle onto and from the said platform; movable means for barring access to the said station; and a programmed electronic unit, set in action consequently to the recognization of a code created with a corresponding device, destined to operate and disengage the said movable access barring means and the said drive elements, respectively, as well as to operate corresponding signalling means when at least one platform is unoccupied.

BRIEF DESCRIPTION OF THE DRAWINGS

The characteristics of the equipment in question are outlined in the ensuing text, with reference to the accompanying tables of drawings, in which:

FIG. 1*a* shows, in a plan view, one of the two curved ends that connect the corresponding extremities of the longitudinal runways of the track;

FIG. 2 shows, diagrammatically in a perspective view, the means for driving the equipment;

FIG. 3 shows one possible block diagram for the programmed unit through which the computerized operation of the equipment is achieved;

FIGS. 6 and 7 each show, diagrammatically in a lateral view, peculiarities in the construction of the end of the platform.

DESCRIPTION OF THE PREFERED EMBODIMENT

Figure 1:
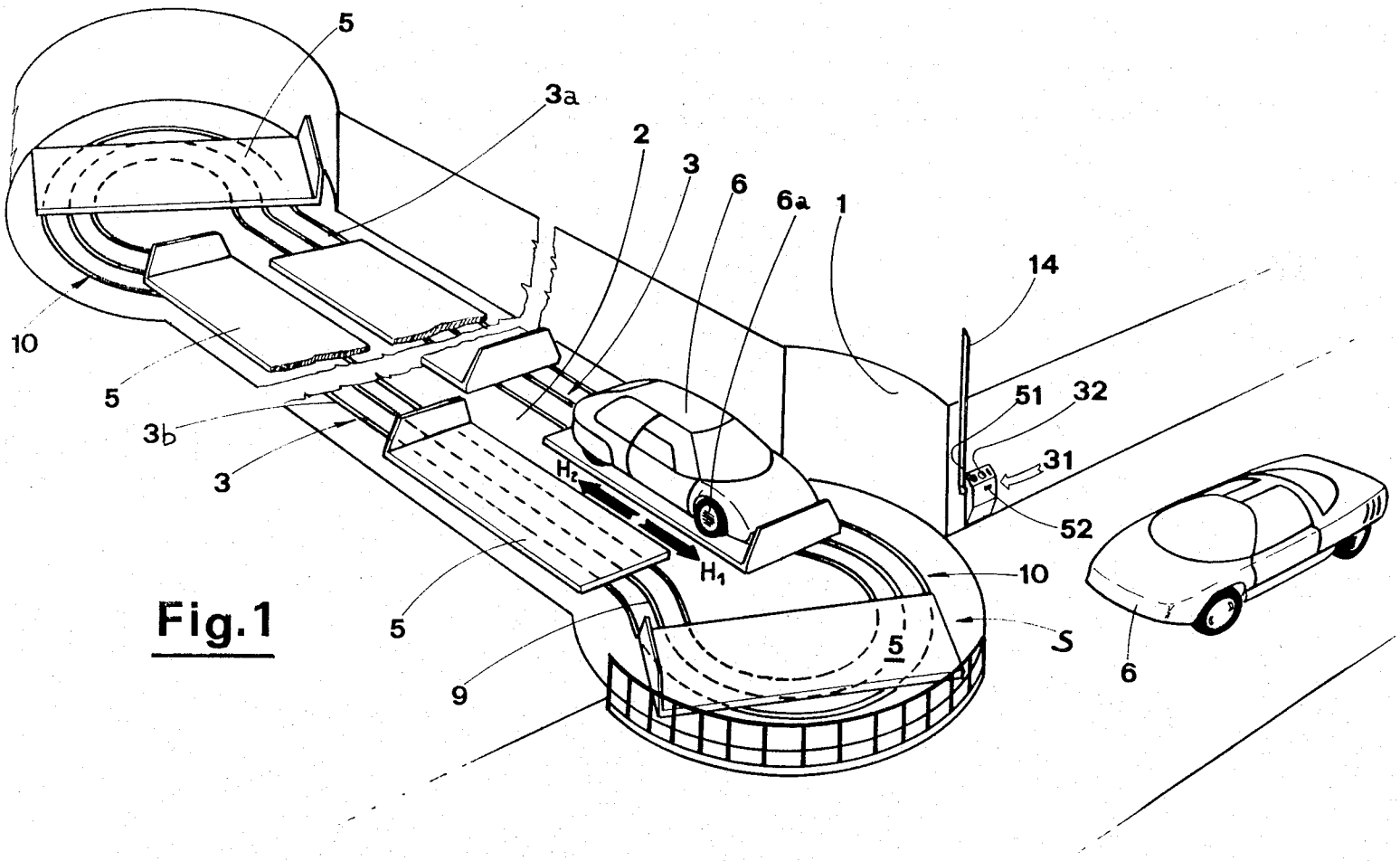
FIG. 1 shows, diagrammatically in a perspective view with certain parts removed, the equipment forming the subject of the invention.

With reference to the said figures, shown at 1 is a bay whose prevalent extension is longitudinal, to the base 2 of which is fixed a track 3 that extends endlessly so as to define two longitudinal runways 3*a* and 3*b*. The corresponding extremities of the said runways are connected through curved ends 10, each of which constituted by two outwardly curved parts 10*a* linked to a circular part 10*b*, the diameter of which is greater than the distance in between the runways 3*a* and 3*b*.

The track 3 serves as bearing and guide means for a plurality of movable elements of support 4, equidistant one with respect to the other, of a known type or of the type more about which will be said below. To each element 4 is fixed a corresponding platform 5 destined to receive a corresponding vehicle 6 (a motocar, for example). The said elements 4 are driven synchronously, in the two directions H1 and H2, by means 8 of a known type, such as those illustrated in FIG. 2, wherein there is a chain 9 as well as a catenary system 12, the latter provided to give motion to the former.

The chain 9 is housed in a groove that extends endlessly inside the two rails of the track 3, and is shaped so as to receive upwardly oriented equidistant pins 53, each of which is coupled to the said movable elements 4.

The catenary system 12 is mounted endlessly around corresponding driving wheels, the driven wheel of these being keyed to a shaft 13 carried in rotation by powering means, not described herein, shown at 23 (FIG. 3). The catenary system 12 is provided with pins 12*a*, the pitch of which is equal to or a multiple of that of the chain 9, that are inserted into the links of this.

With motion given to the elements 4, each platform 5 is able to transit in a station S destined to allow a vehicle 6 to be loaded onto and unloaded from the platform positioned at the said station.

Access to the station S is permitted or impeded by means 14 of a known type (constituted, for example, by a movable bar) operated by corresponding powering means shown at 15 (FIG. 3) that are not described herein since they are of a known type.

At 20 is shown a programmed unit for the computerized operation of the equipment in question.

Connected to the said unit is a reader 21 able to recognize a code created with a corresponding device, for example on a magnetic card 22. The said reader is wired to a block 31 placed at the side of the bar 14 and provided, furthermore, with a panel on which there are illuminated signalling means 32, more about which will be said below.

Also wired to the unit 20 in an interface circuit 42 connected to powering means 23 of a known type, through which the previously mentioned shaft 13 is rotated, and also connected to the aforementioned powering means 15, through which the bar 14 is operated.

Figure 4:
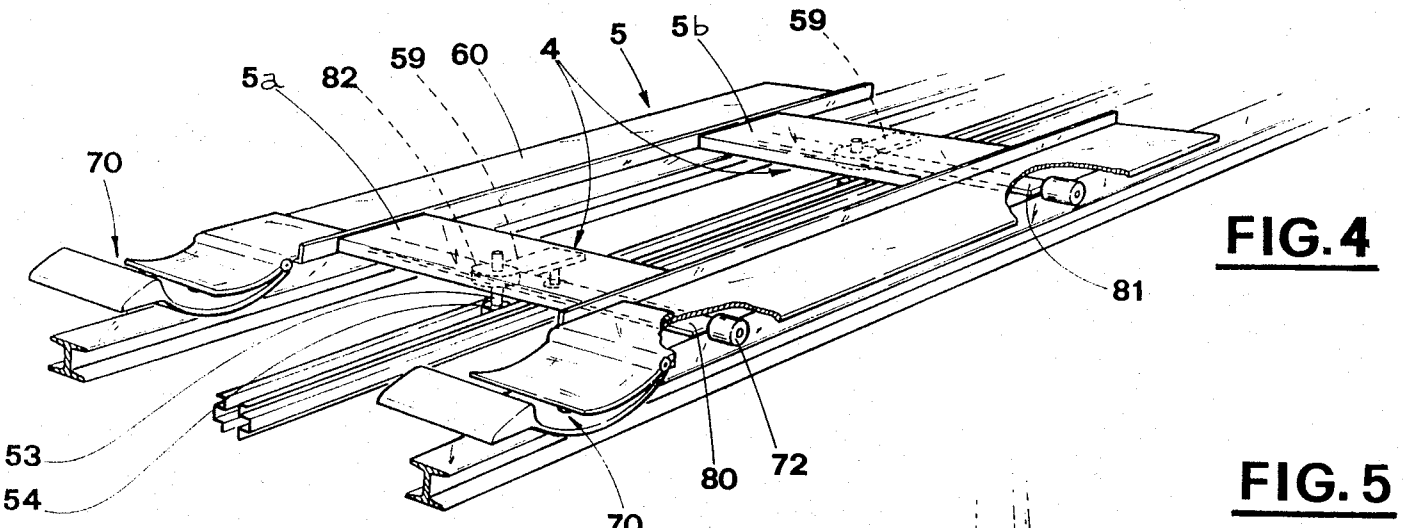
FIG. 4 shows, in a diagrammatic perspective view, one particular embodiment for a platform and the elements of support relevant thereto.
Figure 5:
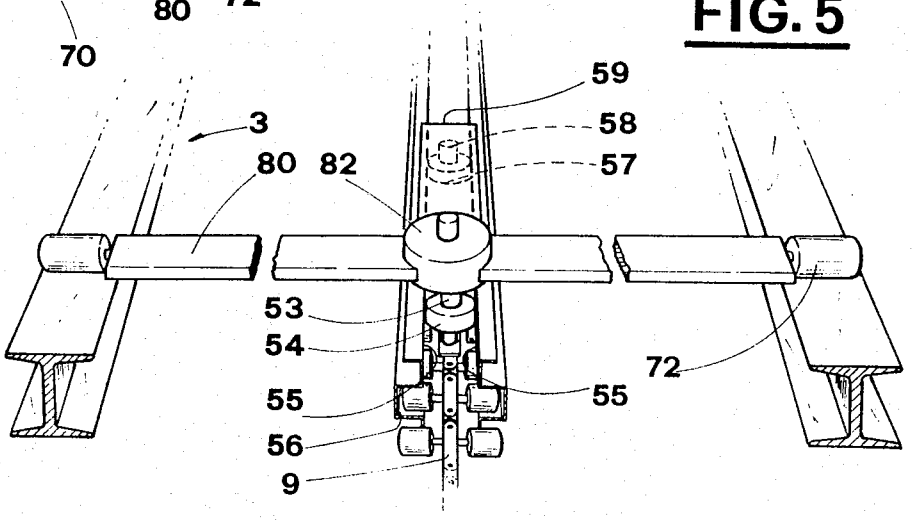
FIG. 5 shows, in a diagrammatic perspective view, one of the two bars that constitute the said elements of support.

In one preferred embodiment, the movable elements 4 are constituted by a front bar 80 and by a rear bar 81 (FIG. 4) that are independent one of the other. Both bars are provided with small wheels 72 (of a known type) that slide on the track 3. The centre part 82 of each bar (for example, in the form of a disk) receives resting thereon, a corresponding crosspiece 5*a* that is an integral part of the platform 5, and is able to rotate, with respect to a vertical pin 53 connected to the said centre part 82, between the bar and the crosspiece. It should be stressed that contact between the bar and the crosspiece occurs solely in the region of the said centre part and, furthermore, that the pins 53 are internal with respect to the corresponding extremities of the platform. Below the said centre part 82, the pin 53 supports an orientation and guide roller 54 that slides between two opposite surfaces 55 (FIG. 5) positioned above the housing 56 destined to receive the said chain 9 and extending similarly to the path followed by this. The pin 53, it will be recalled, is provided with movement by the chain 9. With the pin 53 cooperates another roller 57, this too sliding between the surfaces 55, sustained by a pin 58 restrained to an arm 59 fixed to the said centre part 82 and perpendicular to the corresponding bar.

Consequently, each arm 59 describes a path defined by the guide surfaces 55 of the said rollers 54 and 57, namely a path whose instantaneous curvature centre is, in the region of the curved parts 10*a* and 10*b* of the track 3, coincident with the curvature centres of the said curved parts.

Since each bar is perpendicular to (and integral with) the corresponding arm 59, it follows that the said bar is constantly perpendicular to the instantaneous relative motion direction, and thus that when passing over the said curved parts, it is positioned in the radial direction of the path. In this way, the small wheels 72 roll along the track 3.

The fact of the bars 80 and 81 being independent one of the other and pivotally connected to the platform 5 through vertical pins 53 that are internal with respect to the extremities of the platform itself, results in the following advantages: (a) instead of the platform keeping to the curvature of the track, it is placed with the relevant extremities thereof externally thereto: this makes it possible "to take a curve" in reduced spaces and with accentuated curvatures of the track; (b) the fact that both extremities of the platform are outside the track enables the loading and unloading of the vehicle 6 onto and from the said platform to be effected in the station S in an optimal fashion (see FIGS. 1 and 1*a*).

The platform 5 is constituted by the said crosspieces 5*a* and 5*b*, and by two longitudinal strips 60 on which the wheels of the vehicle 6 are positioned. The front extremity 70 of each strip 60 is shaped for the front wheels 6*a* of the vehicle to fit therein, with sliding caused by the weight of the vehicle being prevented right up to the maximum inclination value of the said runways 3*a* and 3*b*. The foregoing is of extreme importance in cases when the endless track 3 extends partially, or totally, on the slope.

In the examples given in FIG. 6 and 7, the front extremity 70 is concave so that it be able to accept one front wheel 6*a* of the vehicle 6, and at the farthermost point a shaped element 61 is provided that extends above the plane defined by the corresponding strip 60, the purpose of this being to prevent the vehicle sliding in the direction K1.

Articulated to the back of the front extremity 70, along a transverse axis 62, is an oscillating table 63 that is illustrated in FIGS. 6 and 7. In the non-operative position R, the rear part 63*a* of the said table is placed resting on the strip in such a way as to constitute an access ramp for the wheel 6*a* turning thereon in direction K1. The front part 63*b* of the table 63 is curved similarly to the corresponding front extremity 70, and in the non-operative position is raised with respect to the underneath front extremity 70.

The table 63 adopts two characteristic extreme positions: namely the prior mentioned non-operative position R, and an operative position I. The transition from position R to position I occurs when the weight applied to the front part 63*b* exceeds a predetermined value certainly less than the apportionment of the weight of the vehicle that the front wheel under examination has to bear. The foregoing is achieved through suitable elements 65 for triggering the locking and unlocking of the oscillation of the table 63 with respect to the platform 5. The said elements 65 are provided with elastic means 66 which, in the example given in FIG. 6, are connected to two opposite dome shaped parts 67 that define a housing 68 through which passes, in contrast with the said elastic means, a protruberance 69 integral with the front part 63*b*, while in the example given in FIG. 7, the elastic means 66 are coupled to a spherical element 92*a*, restrained to one extremity of an arm 92 locked to the table 63, that snap inserts into one or the other of two fixed recesses 71*a* and 71*b*.

With the table 63 in the operative position I shown with dashes in FIGS. 6 and 7, the front part **63*b* mates with the underneath front extremity 70, while the rear part 63*a* is raised with respect to the strip 60 so as to intercept the vehicle 6** resting on the platform.

In this way, the said rear part **63*a* constitutes a "stop" since the wheel 6*a* tends to move in the direction K2. The moment generated, with respect to the axis 62, by the wheel that presses down on the rear part 63*a* is naturally contrasted by the reverse moment, with respect to the said axis 62, consequent to the elastic pressure of the means 66** that can be adjusted by setting these appropriately.

Obviously, the wheel locking action on the part of the rear part **63*a* in the operative position I is certainly ensured up to a maximum inclination value of the platform 5. It follows that the slope of the track 3** must be lesser in value than that of the platform.

At the time the vehicle is being unloaded from the platform, the tractive force of the vehicle in the direction K2 is more than sufficient to cause the front wheels **6*a* to move upwards from the front extremity 70 to the flat section of the strips 60. This enables each table 63** to be returned from the operative position I in the non-operative position R.

It should be stressed that in place of the elements 65 illustrated in FIGS. 6 and 7, use can be made of other elements that perform the prior mentioned functions. Emphasis should also be laid on the fact that the front part **63*b* can also define the front extremity 70 of the corresponding strip 60; for this it is sufficient for the said part to have a concave profile in such a way as to accept the wheel 6*a* therein, and that it be provided at the front with the said shaped element 61**.

A description now follows of how the equipment according to the invention operates.

In the event of at least one platform 5 being free, the unit 20 notifies the outside area of the said situation through the operation of the signalling means 32, for example, an illuminated indicator lamp. The potential user, seeing that the possibility exists of parking a vehicle within the bay 1, inserts a card 22 in a slit provided for this purpose in the block 31. At this juncture, two situations are possible. The first relates to the card not being recognized by the unit 20, and in this case neither the powering means 23 nor the powering means 15 are set in motion. In the second situation the unit 20 duly recognizes the card and thus the powering means 23 are actuated so that a free platform 5 be positioned at the station S, preferably the platform nearest thereto.

As soon as an unoccupied platform is in position at the station S, the powering means 23 are cut off and, contemporaneously, the powering means 15 that permit access to the station on the part of the user, are set in operation.

Once the operation of loading the vehicle onto the platform has been completed, the user removes the card from the slit; this action is detected by the unit 20 and this causes the powering means 15 to operate and bar anew access to the station S.

As a consequence of the action taken thereon by the unit 20, the data regarding the identification number of the platform used and the moment when the vehicle was admitted, is memorized on the card in the possession of the user.

Obviously, as experts in the field concerned know, the user can insert the card into the slit in such a way as to permit recognization and then immediately remove it; the unit 20 actions the powering means 23 and 15 as stated above, while the subsequent operation of the powering means 15 can be set either through a timer or, preferably, be made dependent on the exiting of the user from the station S; the relevant data obviously being sent to the unit 20 via known systems.

In a variant with respect to the embodiment described above, the block 31 is provided with a key 51 as well as with a slit 52 through which the cards 22 are issued. More precisely, when the potential user sees that a platform is free (indicator lamp 32 alight), he or she presses the key 51 and this, naturally with the consent of the unit 20, allows a card 22 to be issued via the slit 52. The said card remains partially inserted in the slit 52 until the user, upon completion of the loading of the vehicle onto the platform positioned at the station S, finally extracts it from the said slit; this, subject to the user leaving the station, enables the powering means 15 to be operated and thus access to the station S to be barred.

When the user wishes to reclaim his or her vehicle, the card has to be reinserted in the slit in the block 31. In this case, the unit 20 subjects the card to recognization whereby the corresponding platform be traced and, in consequence, be positioned at the station S in order to allow the user, once the bar 14 has been raised, to take possession of the vehicle.

The advantages, listed hereinafter, that the invention offers are numerous.

Because of the particular conformation of the equipment in question it is possible, on one hand, to make the best possible use of the bay 1, even if this extends partially or totally on the slope, and on the other hand, to load and unload the vehicles onto and from the platforms in a fast and easy manner, without outside assistance and, this is a fact of considerable importance, without any danger of banging into vehicles parked previously in the bay.

Another advantage, consequential also to the use of the programmed unit 20, comes from the fact that the parking is effected entirely on a self service basis, with the vehicles being deposited and removed in spaces of time that are limited and certainly considerably less than those required to complete identical operations in the car parks known to date. Furthermore, the vehicles standing there are locked, and also because of the particular conformation of the equipment in question, any danger of articles being stolen from the garaged vehicles and/or of the said vehicles being tampered with is rendered practically nil.

In addition to the above listed advantages is also the fact that the computerized operation of the equipment makes it possible to restrict the use of personnel to a bare minimun. Indeed, since the car park is, as stated previously, run on a self service basis, one single person can take monies due for the garaging of the vehicles, while in the event of the adoption of cards (of a low set cost) that cancel magnetically (or using some other known system) the cost memorized thereon, even one single person may not be necessary; in the latter instance it would be sufficient just to have the said cards placed on sale.

It is stressed that since the parking cost is established by the unit 20 on the basis of set mean time tariffs, the calculation is extremely precise, this being completely in favour of the user.

To conclude, the particular conformation of the track 3 and of the platform 5 makes it possible for the latter to take reduced space curves and to be positioned, in the curves, externally to the track in such a way as to render the loading and unloading phases optimal.

It is understood that the foregoing description has been given purely as an unlimited example, and thus that any variants of a practical nature (for example, an endless track 3 extending in such a way as to define three or more longitudinal runways, with the consequent formation of three or more rows of side by side vehicles) fall within the framework of protection afforded to the invention as described above and claimed hereinafter.

What is claimed is:

1. A self service, computer operated, mechanical-electronic equipment for parking vehicles closely in side by side rows, comprising: at least one guide fixed to a base and positioned above said base, said guide constituted by at least two endless rails each configured to define a longitudinal intermediate section and two circular end sections, and a track profiled similarly to the profile of said rails and positioned between said rails; at least one pair of movable elements of support, equidistant one with respect to the other, carried by said rails in a way to undergo sliding motion controlled by said track; at least one platform on which to receive an identical number of vehicles; each platform resting on a pair of said movable elements of support; means for driving, synchronously said movable elements of support with it being possible for each platform to transit at a station for loading and unloading at least one vehicle onto and from the said platform, said pair of movable elements of support constituted by at least two independent bars, namely a front bar and a rear bar, the center part of each bar being pivotally connected to a corresponding platform, said bars being able to rotate with respect to said platform by vertical pins positioned between said platform and said center part of each bar, said vertical pins being connected to said drive means by said vertical pins contacting said drive means; and means for orienting and guiding said bars and designed to maintain each of said bars substantially perpendicular to the instantaneous relative motion direction, said means for orienting and guiding the bars comprising for each bar, two rollers, the first of which is sustained by the aforesaid vertical pin connected to said drive means, whereas the second is sustained by a further vertical pin rigidly fitted to the said center part of the corresponding bar through an arm, both said rollers sliding in alignment between two opposite inner surfaces of said track to cause the rotation of the related said bar irrespective of the curving radius of said track and rails.

2. A self service, computer operated, mechanical-electronic equipment for parking vehicles closely in side by side rows, comprising: at least one guide fixed to a base and positioned above said base, said guide constituted by at least two endless rails each configured to define a longitudinal intermediate section and two circular end sections, and a track profiled similarly to the profile of said rails and positioned between said rails; at least one pair of movable elements of support, equidistant one with respect to the other, carried by said rails in a way to undergo sliding motion controlled by said track; at least one platform on which to receive an identical number of vehicles; each platform resting on a pair of said movable elements of support; means for driving, synchronously said movable elements of support with it being possible for each platform to transit at a station for loading and unloading at least one vehicle onto and from the said platform, said pair of movable elements of support constituted by at least two independent bars, namely a front bar and a rear bar, the center part of each bar being pivotally connected to a corresponding platform, said bars being able to rotate with respect to said platform by vertical pins positioned between said platform and said center part of each bar, said vertical pins being connected to said drive means by said vertical pins contacting said drive means; and means for orienting and guiding said bars and designed to maintain each of said bars substantially perpendicular to the instantaneous relative motion direction, said means for orienting and guiding the bars comprising for each bar, two rollers, the first of which is sustained by the aforesaid vertical pin connected to said drive means, whereas the second is sustained by a further vertical pin rigidly fitted to the said center part of the corresponding bar through an arm, both said rollers sliding in alignment between two opposite inner surfaces of said track to cause the rotation of the related said bar irrespective of the curving radius of said track and rails, the front extremity of each said platform is curved and provided with a concavity that defines a housing for receiving the front wheels of a vehicle that is resting on said platform, said extremity being provided at the front with a shaped element that extends above the level of the platform as well as with slide preventive means, said slide preventive means comprising: an oscillating table articulated in its center to said platform along a transverse axis and having a front part turned towards said front extremity and a rear part turned towards the back part of said platform; elements for snap locking the said table from oscillating in a non-operative position or an operative position, the non-operative positioned defined by said rear part of said table resting on said platform, and the operative positioned defined by said rear part being raised with respect to said platform; the changeover from said non-operative position to said operative position being consequential to the presence of the front wheels of a vehicle resting on said front part, the reverse transition being consequential to the creation of a predetermined force pressing down on the said rear part of the table, greater than the action of contrast resulting from the pressure applied by the elastic means connected to said elements.

3. Equipment according to claim 2, wherein said front extremity of the platform is defined by the front part of the said oscillating table.

* * * * *